US010524633B2

(12) United States Patent
Lee et al.

(10) Patent No.: US 10,524,633 B2
(45) Date of Patent: Jan. 7, 2020

(54) DISHWASHER AND METHOD OF CONTROLLING THE SAME

(71) Applicant: LG Electronics Inc., Seoul (KR)

(72) Inventors: Sanghoon Lee, Seoul (KR); Moonkee Chung, Seoul (KR); Jaechul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 153 days.

(21) Appl. No.: 14/634,308

(22) Filed: Feb. 27, 2015

(65) Prior Publication Data

US 2015/0164298 A1 Jun. 18, 2015

Related U.S. Application Data

(62) Division of application No. 14/142,379, filed on Dec. 27, 2013, now abandoned.

(30) Foreign Application Priority Data

Dec. 28, 2012 (KR) ..... 10-2012-0156991

(51) Int. Cl.
*A47L 15/42* (2006.01)
*A47L 15/00* (2006.01)

(52) U.S. Cl.
CPC ..... *A47L 15/0047* (2013.01); *A47L 15/4221* (2013.01); *A47L 15/4225* (2013.01)

(58) Field of Classification Search
CPC ..... A47L 15/0047; A47L 15/4221; A47L 15/4225
See application file for complete search history.

(56) References Cited

U.S. PATENT DOCUMENTS 4,781,206 A 11/1988 Noren
5,429,679 A * 7/1995 Young, Jr. ..... A47L 15/0002 134/10

(Continued)

FOREIGN PATENT DOCUMENTS

CN 101043837 A 9/2007
CN 101336821 A 1/2009

(Continued)

*Primary Examiner* — Sharidan Carrillo
(74) *Attorney, Agent, or Firm* — Dentons US LLP

(57) ABSTRACT

The present invention relates to a dishwasher that can save wash water for cleaning and a method of controlling the dishwasher. A method of controlling a dishwasher according to an exemplary embodiment of the present invention is a method of controlling a dishwasher having a circulation channel through which wash water is supplied to wash a plurality of arms by a wash pump after collecting the wash water, sprayed in to a tub from the plurality of wash arms, in a sump, and the method includes: performing a first water-supplying for supplying a predetermined amount of wash water into the dishwasher by opening a water supply valve; performing a first washing where the plurality of wash arms spray the wash water into the tub to be circulated by operating the wash pump; performing a first draining for saving recycling wash water as much as the volume of the circulation channel and draining the rest of the wash water to the outside of the dishwasher by operating the wash pump and the drain pump; and performing a second water-supplying for supplying the amount of wash water except the amount of the recycling wash water from a predetermined amount of wash water into the dishwasher by opening the water supply valve.

7 Claims, 9 Drawing Sheets

(56) References Cited

U.S. PATENT DOCUMENTS 8,157,923 B1* 4/2012 Mohrbacher, Jr. ..... A47L 15/0031 134/10
2008/0314414 A1 12/2008 Hildenbrand
2009/0139553 A1 6/2009 Park
2010/0114139 A1* 5/2010 Zepf ..... A61B 17/1611 606/184
2010/0139719 A1* 6/2010 Gnadinger ..... A47L 15/23 134/56 D
2010/0236588 A1* 9/2010 Busing ..... A47L 15/4221 134/184
2011/0114139 A1 5/2011 Buesing et al.
2011/0132403 A1 6/2011 Buerkle et al.
2012/0042908 A1* 2/2012 Jerg ..... A47L 15/0021 134/18
2012/0279527 A1* 11/2012 Lee ..... A47L 15/0036 134/106
2013/0092189 A1* 4/2013 Tang ..... A47L 15/4297 134/18
2013/0092197 A1* 4/2013 Hodge ..... A47L 15/00 134/29
2014/0060579 A1* 3/2014 Slabbekoorn ..... A47L 15/4219 134/10
2016/0003506 A1* 1/2016 Giraldo ..... F28D 21/0012 62/79

FOREIGN PATENT DOCUMENTS

CN 101416856 A 4/2009
CN 102481081 A 5/2012
CN 102821667 A 12/2012
DE 102008044952 A1 3/2010
EP 2052664 A2 4/2009
EP 2510864 A1 10/2012
GB 2509617 A * 7/2014
JP 2004-298867 A 10/2004
KR 970010420 B1 * 6/1997
KR 1019970009740 * 6/1997
KR 10-0917826 B1 9/2009
KR 10-2011-0107517 A 10/2011
KR 10-2012-0116326 A 10/2012
KR 10-2013-0070275 A 6/2013
WO 2010/025051 A1 3/2010
WO 2011015313 A1 2/2011

* cited by examiner

DISHWASHER AND METHOD OF CONTROLLING THE SAME

CROSS-REFERENCE TO RELATED APPLICATION

This application is a Divisional of application Ser. No. 14/142,379 filed on Dec. 27, 2013, which claims priority benefit of Korean Patent Application No. 10-2012-0156991, filed on Dec. 28, 2012, in the Korean Intellectual Property Office, the disclosure of which is incorporated herein by reference in its entirety.

BACKGROUND OF THE INVENTION

1. Field of the Disclosure

The present invention relates to a dishwasher and a method of controlling the same, and more particularly to a dishwasher that can save wash water for cleaning and a method of controlling the dishwasher.

2. Description of the Related Art

Dishwashers are appliances that remove food residue on dishes with high-pressure wash water sprayed from wash arms.

Dishwashers usually include a tub forming a cleaning compartment and a sump mounted on the bottom of the tub and storing wash water. The wash water is pumped to wash arms by a wash pump in the sump and the wash water pumped to the wash arms spray the wash water at high pressure through an ejection hole formed in the wash arms. The wash water sprayed at high pressure hits on dishes and the dirt such as food residue on the dishes falls down to the bottom of the tub.

It is required for those dishwashers to save wash water for cleaning.

SUMMARY OF THE INVENTION

The present invention has been made in an effort to provide a dishwasher that can save wash water for cleaning and a method of controlling the dishwasher.

The objects of the present invention are not limited to those described above and other objects may be made apparent to those skilled in the art from claims.

In order to achieve the objects, a method of controlling a dishwasher according to an exemplary embodiment of the present invention is a method of controlling a dishwasher having a circulation channel through which wash water is supplied to wash a plurality of arms by a wash pump after collecting the wash water, sprayed in to a tub from the plurality of wash arms, in a sump, and the method includes: performing a first water-supplying for supplying a predetermined amount of wash water into the dishwasher by opening a water supply valve; performing a first washing where the plurality of wash arms spray the wash water into the tub to be circulated by operating the wash pump; performing a first draining for saving recycling wash water as much as the volume of the circulation channel and draining the rest of the wash water to the outside of the dishwasher by operating the wash pump and the drain pump; and performing a second water-supplying for supplying the amount of wash water except the amount of the recycling wash water from a predetermined amount of wash water into the dishwasher by opening the water supply valve.

The method may further include: performing a second washing where the plurality of wash arms spray the wash water into the tub by operating the wash pump after the second water-supplying; and performing a second draining for draining completely the wash water to the outside of the dishwasher by stopping the wash pump and operating the drain pump, and may further include performing a third water-supplying for supplying a predetermined amount of wash water into the dishwasher by opening the water supply valve.

The method may further include: performing a second washing where the plurality of wash arms spray wash water into the tub by operating the wash pump after the second water-supplying; and performing a second draining for saving recycling wash water as much as the volume of the circulation channel and draining the rest of the wash water to the outside of the dishwasher by operating the wash pump and the drain pump.

In the method, a channel switch unit for selectively supplying wash water to at least one of the plurality of wash arms may be disposed in the circulation channel, and the channel switch unit may be controlled to adjust the amount of recycling wash water in the first draining.

The first draining may include: operating the wash pump and controlling the channel switch unit in accordance with the amount of recycling wash water; operating the drain pump while keeping the wash pump operating; and stopping both of the wash pump and the drain pump, when there is no load sensed in the drain pump.

The first draining may include: operating the wash pump and controlling the channel switch unit in accordance with the amount of recycling wash water; operating the drain pump while keeping the wash pump operating; and stopping the wash pump and then stopping the drain pump, when there is no load sensed in the drain pump.

In order to achieve the objects, a dishwasher according to an exemplary embodiment of the present invention includes: a tub; a plurality of wash arms for spraying wash water into the tub; a sump for collecting the wash water sprayed into the tube; a drain pump for draining the wash water collecting in the sump to the outside; a wash pump for supplying the wash water collecting in the sump to the plurality of wash arms; and a controller configured to operate the wash pump to form a circulation channel through which the wash water is supplied to the plurality of wash arms after collecting the wash water, sprayed from the plurality of wash arms, in the sump and operate the drain pump tosave recycling wash water as much as the volume of the circulation channel and draining the rest of the wash water.

The dishwasher may further include a water supply valve for supplying wash water from an external water supplier, and the controller may be configured to open the water supply valve to supply the amount of wash water except the amount of the recycling wash water from a predetermined amount of wash water from the external water supplier after saving the recycling wash water and draining the rest of the wash water.

The controller may stop both of the wash pump and the drain pump, when there is no load sensed in the drain pump.

The dishwasher may further include a channel switch unit for selectively supplying wash water to at least one of the plurality of wash arms.

The controller may control the channel switch unit to adjust the amount of the recycling wash water.

The dishwasher may include a plurality of wash arm connection channels connecting the wash arms to the sump, respectively, and the sump may have a plurality of connection taps selectively opened/closed and connected with the wash arm connection channels, respectively, by the channel switch unit.

The channel switch unit may include: a rotary plate having a plurality of switch holes corresponding to at least one of the connection taps; and a channel switch motor for rotating the rotary plate. The controller may control the channel switch motor to adjust the amount of the recycling wash water.

The details of other exemplary embodiments are included in the following detailed description and the accompanying drawings.

DETAILED DESCRIPTION OF THE EMBODIMENT

Figure 1:
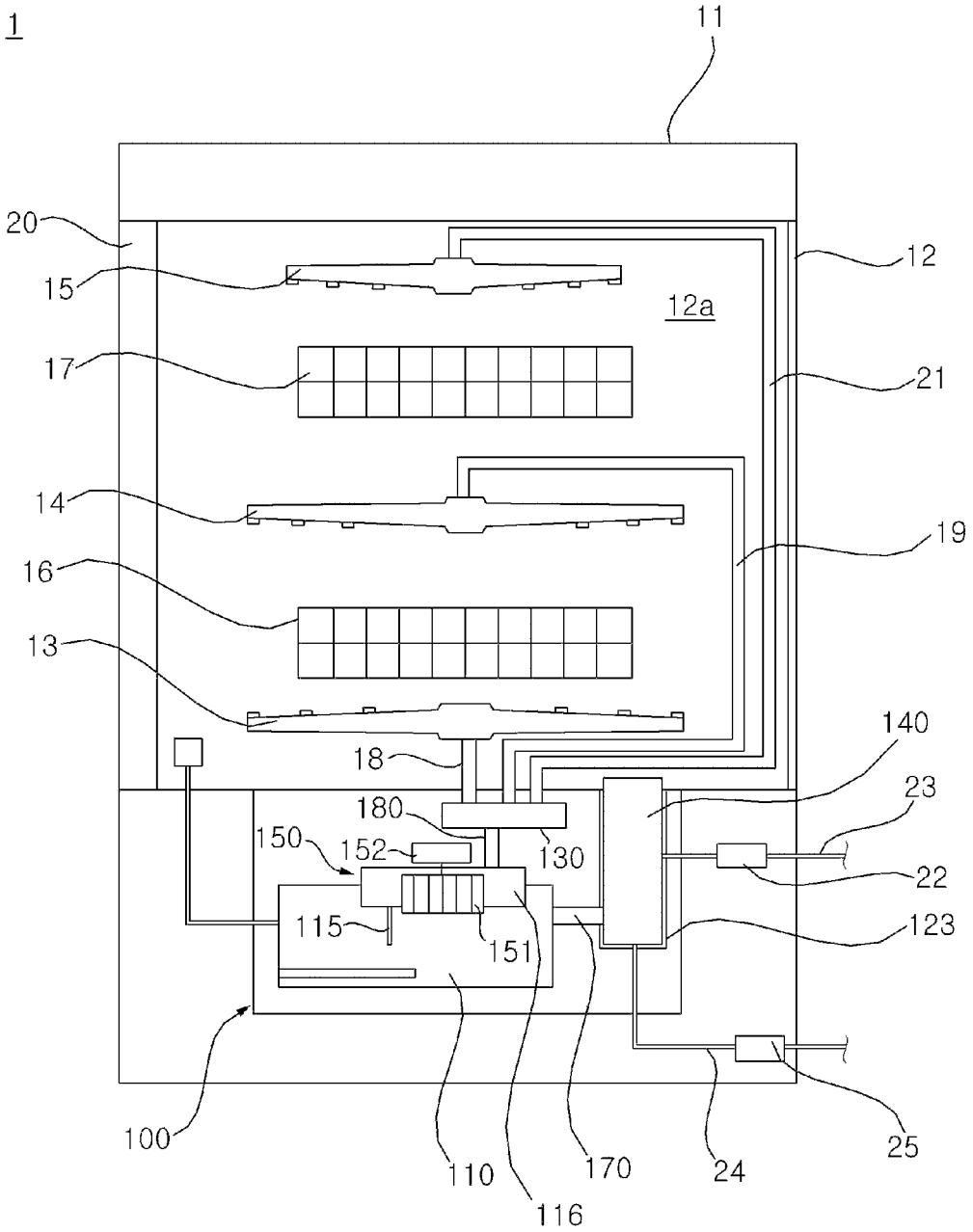
FIG. 1 is a schematic view illustrating the configuration of a dishwasher according to an exemplary embodiment of the present invention.

The advantages and features of the present invention, and methods of achieving them will be clear by referring to the exemplary embodiments that will be describe hereafter in detail with reference to the accompanying drawings. However, the present invention is not limited to the exemplary embodiments described hereafter and may be implemented in various ways, and the exemplary embodiments are provided to complete the description of the present invention and let those skilled in the art completely know the scope of the present invention and the present invention is defined by claims. Like reference numerals indicate like components throughout the specification.

Hereinafter, the present invention will be described with reference to the drawings illustrating a dishwasher and a method of controlling the dishwasher according to exemplary embodiments of the present invention.

Figure 2:
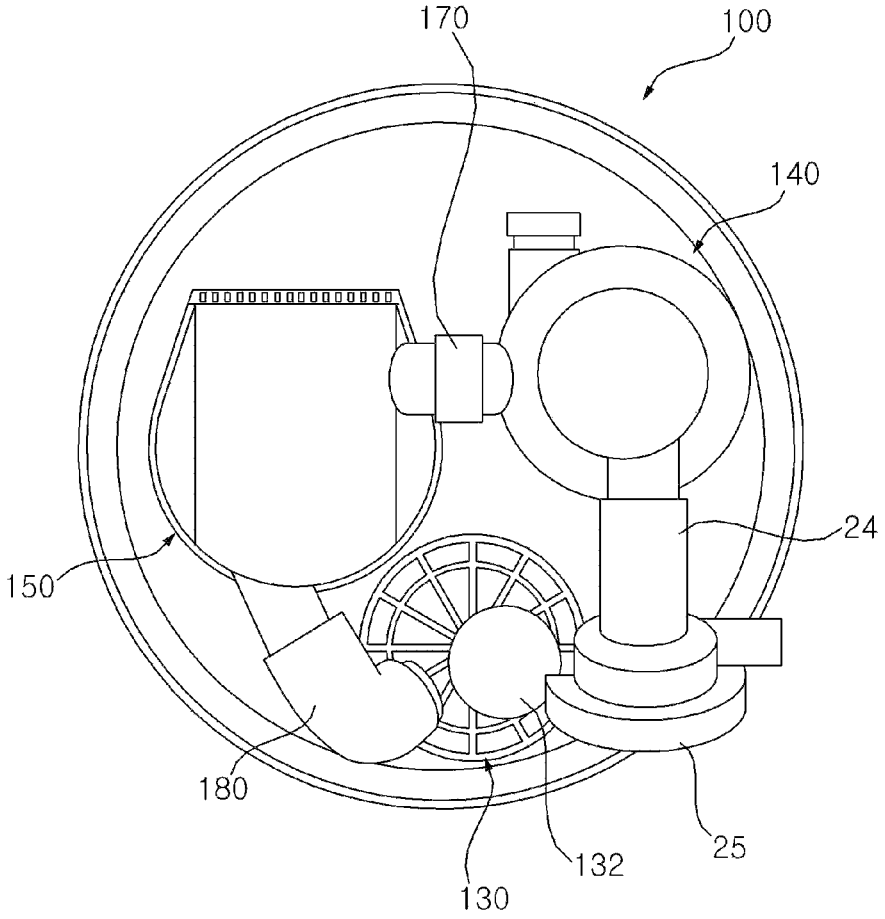
FIG. 2 is a bottom view of a sump of the dishwasher shown in FIG. 1.
Figure 3:
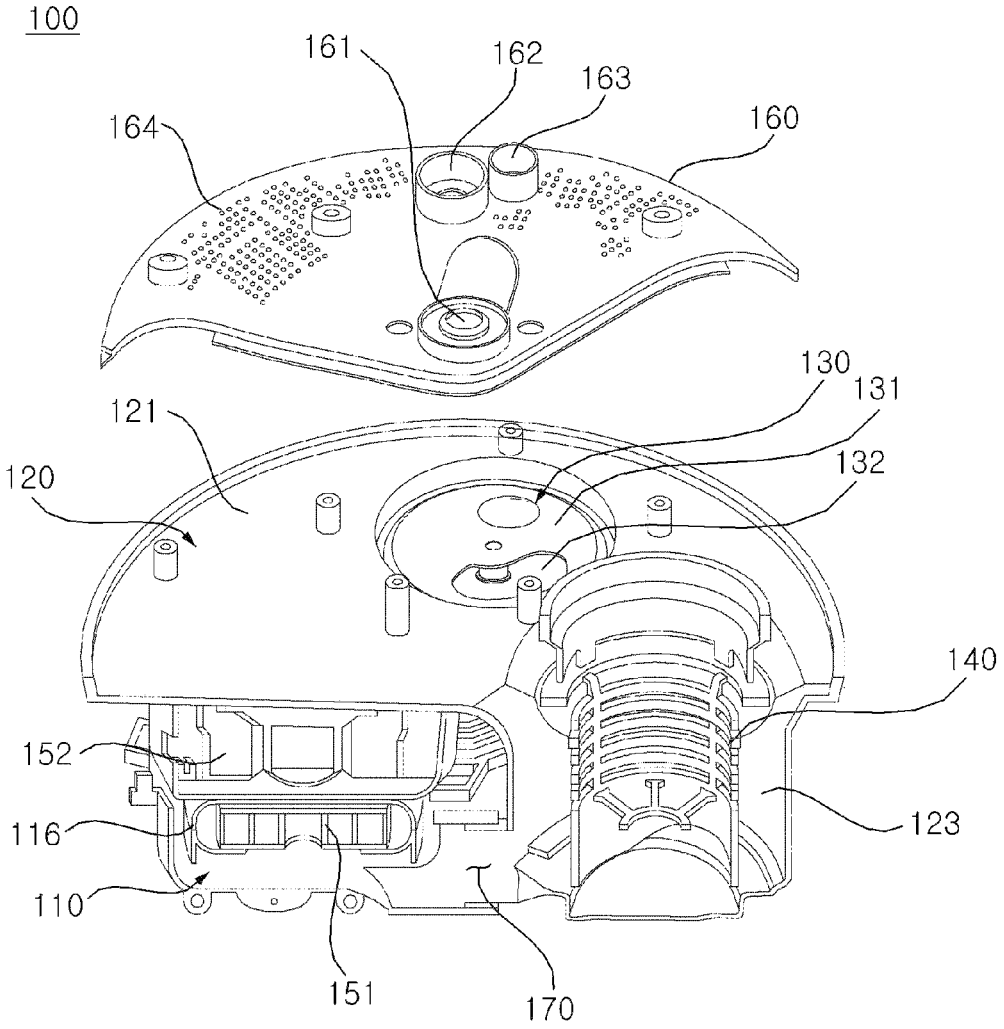
FIG. 3 is a partial exploded perspective view of the sump of the dishwasher shown in FIG. 1.
Figure 4:
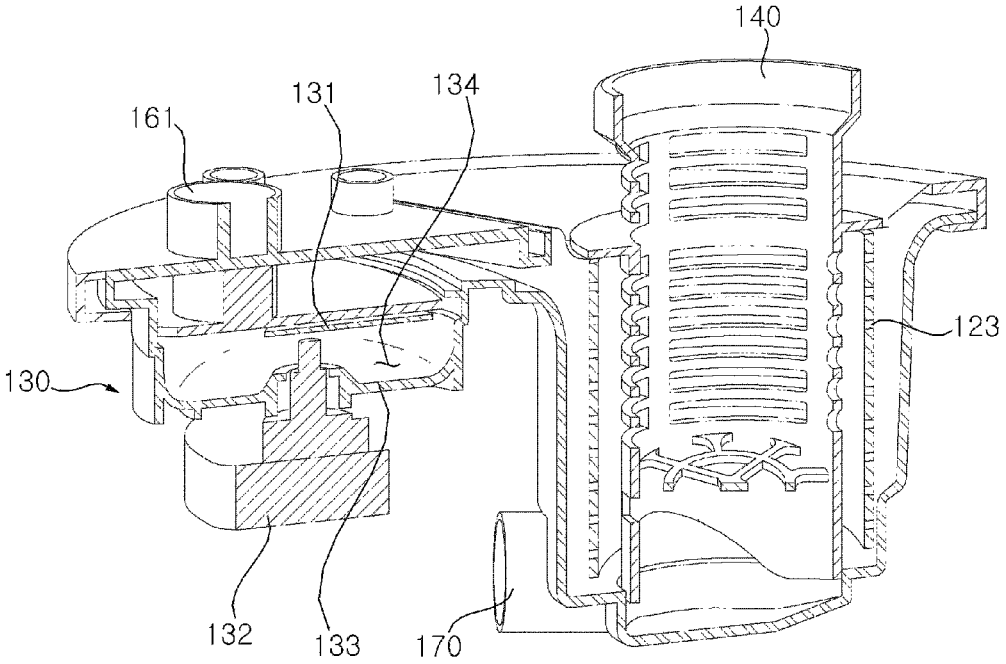
FIG. 4 is a partial cross-sectional view of the sump of the dishwasher shown in FIG. 1.
Figure 5:
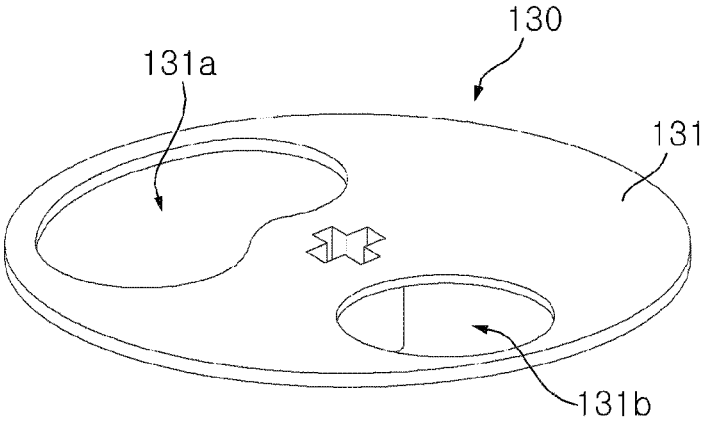
FIG. 5 is a perspective view of a rotary plate of the dishwasher shown in FIG. 1.

FIG. 1 is a schematic view illustrating the configuration of a dishwasher according to an exemplary embodiment of the present invention, FIG. 2 is a bottom view of a sump of the dishwasher shown in FIG. 1, FIG. 3 is a partial exploded perspective view of the sump of the dishwasher shown in FIG. 1, FIG. 4 is a partial cross-sectional view of the sump of the dishwasher shown in FIG. 1, and FIG. 5 is a perspective view of a rotary plate of the dishwasher shown in FIG. 1.

A dishwasher 1 according to an exemplary embodiment of the present invention includes a case 11 forming the external appearance, a tub 12 forming a cleaning compartment 12*a* which receives dishes and in which wash water for cleaning dishes is sprayed, a door 20 disposed on the front of the tub 12 and opening/closing the cleaning compartment 12*a*, and a sump 100 disposed under the tub 12 and collecting the wash water.

A plurality of racks 16 and 17 holding dishes and a plurality of wash arms 13, 14, and 15 spraying wash water to the dishes in the racks 16 and 17 are provided in the tub 12.

The racks 16 and 17 include a lower rack 16 at a lower portion and an upper rack 17 at an upper portion in the cleaning compartment 12*a*. The lower rack 16 and upper rack 17 are vertically spaced and can be drawn forward out of the tub 12.

The plurality of wash arms 13, 14, and 15 include a first wash arm 13 which sprays wash water upward toward the lower rack 16, a second wash arm 14 which sprays wash water downward toward the lower rack 16, and a third wash arm 15 which sprays wash water downward toward the upper rack 17.

The plurality of wash arms 13, 14, and 15 are supplied with wash water through a plurality of wash arm connection channels 18, 19, and 21 from the sump 100. The wash arm connection channels 18, 19, and 21 connect the plurality of wash arms 13, 14, and 15 with the sump 100, respectively.

The wash arm connection channels 18, 19, and 21 include a first wash arm connection channel 18 connected with the first wash arm 13, a second wash arm connection channel 19 connected with the second wash arm 14, and a third wash arm connection channel 21 connected with the third wash arm 15.

The first wash arm 13, second wash arm 14, and third wash arm 15 are supplied with wash water from the sump 100, through the first wash arm connection channel 18, second wash arm connection channel 19, and third wash arm connection channel 21, respectively.

The sump 100 includes a sump housing 120 forming the external appearance of the sump 100 and storing wash water and a sump cover 160 disposed on the sump housing 120. A water-collecting part 110, a filter seat 123, and a water-collecting channel 170 are formed in the sump housing 120.

The filter seat 123 is recessed inward the sump housing 120 in order to allow the wash water flowing into the sump 100 from the tub 12 to collect well. A filter 140 is detachably disposed in the filter seat 123. The filter 140 filters off impurities such as food residue in wash water. The filter 140 is detachably mounted in the filter seat 123.

The wash water flowed in the filter seat 123 from the tub 12 is filtered by the filter 140 and then guided to the water-collecting part 110 through the water-collecting channel 170. The water-collecting channel 170 is a channel connecting the filter seat 123 and the water-collecting part 110.

The water-collecting part 110 stores the wash water which passed through the water-collecting channel 170 after flowing into the filter seat 123 from the tub 12. The wash water collecting in the water-collecting part 110 is pumped to at least one of the plurality of wash arms 13, 14, and 15 by a wash pump 150.

The wash pump 150 pumps the wash water in the water-collecting part 110 to at least one of the plurality of wash arms 13, 14, and 15. The wash pump 150 includes a wash motor 152 generating torque, an impeller 151 rotated by the motor 152 and making wash water flow, and a flow guide 116 surrounding the impeller 151 and guiding the wash water discharged through between blades of the impeller 151.

When the wash pump 150 operates, at least one of the wash arms 13, 14, and 15 sprays wash water into the tub 12. The wash water sprayed into the tub 12 flows into the sump 100, such that wash water circulates between the sump 100 and the tub 12.

The sump cover 160 is disposed on the sump housing 120. A plurality of fine holes 164 is formed through the sump cover 160 to pass the wash water flowing to the filter seat 123 of the sump housing 120 from the tub 12.

A plurality of connection taps 161, 162, and 163 selectively opened/closed by a channel switch unit 130 to be described below is formed at the sump cover 160. The connection taps 161, 162, and 163 include a first connection tap 161 connected with the first wash arm connection channel 18, a second connection tap 162 connected with the second wash arm connection channel 19, and a third connection tap 163 connected with the third wash arm connection channel 21.

The dishwasher 1 includes a water supply channel 23 through which wash water supplied from an external water supplier flows, and a water supply valve 22 opening/closing the water supply channel 23. In the exemplary embodiment, the water supply channel 23 is directly connected with the filter seat 123 of the sump 100, such that the wash water supplied from an external water supplier through the water supply channel 23 flows to the water-collecting part 110 after passing through the filter 140. Depending on exemplary embodiments, the water supply channel 23 may be directly connected with the tub 12 to allow the wash water supplied from an external water supplier through the water supply channel 23 to be supplied into the tub 12.

The dishwasher 1 includes a drain channel 24 connected with the filter seat 123 of the sump 100 and guiding the wash water in the sump 10 to the outside of the dishwasher 1 and a drain pump 25 disposed on the drain channel 24 and pumping wash water to the outside of the dishwasher 1. When the drain pump 25 operates, the wash water in the filter seat 123 of the sump 100 is discharged to the outside of the case 11 through the drain channel 24. The drain pump 25 is controlled to be able to stop, when there is no load sensed.

The dishwasher 1 includes a wash water supply channel 180 disposed in the sump 100 and guiding the wash water, which is pumped by the wash pump 150, to the channel switch unit 130 and the channel switch unit 130 supplying the wash water, which is pumped to the wash water supply channel 180 by the wash pump 150, to at least one of the plurality of wash arms 13, 14, and 15.

The wash water supply channel 180 is connected with the flow guide 116 of the wash pump 150. The wash water supply channel 180 guides the wash water, which is pumped to the water-collecting part 110 by the wash pump 150, to the channel switch unit 130.

The channel switch unit 130 allows the wash water pumped by the wash pump 150 to flow selectively to at least one of the first wash arm 13, second wash arm 14, and third wash arm 15. The channel switch unit 130 includes a channel switch unit housing 133 which forms the external appearance of the channel switch unit 130 and in which wash water flows, a channel switch motor 132 which generates torque, and a rotary plate 131 which controls the flow of wash water while rotated by the channel switch motor 132.

A switch water-collecting part 134 is formed in the channel switch unit housing 133 and the wash water pumped to the wash water supply channel 180 by the wash pump 150 flows to the switch water-collecting part. Wash water may collect in the switch water-collecting part 134, when the wash pump 150 does not operate. The rotary plate 131 is disposed over the channel switch unit 133.

The rotary plate 131 is positioned between the channel switch unit housing 133 and the sump cover 160 and selectively opens/closes the connection taps 161, 162, and 163 of the sump cover 160. A plurality of switch holes 131*a* and 131*b* is formed through the rotary plate 131. The switch holes 131*a* and 131*b* include a first switch hole 131*a* circumferentially extending and a second switch hole 131*b* formed in a circle.

The rotary plate 131 is rotated in stages by the channel switch motor 132. As the rotary plate 131 is rotated by the channel switch motor 132, the switch holes 131*a* and 131*b* of the rotary plate 131 move to the position corresponding to at least one of the connection taps 161, 162, and 163 and the wash water in the switch water-collecting part 134 is sprayed from at least one of the plurality of wash arms 13, 14, and 15.

At least one of the plurality of wash arms 13, 14, and 15 sprays wash water, when at least one of the switch holes 131*a* and 131*b* of the rotary plate 131 communicates with at least one of the connection taps 161, 162, and 163 of the sump cover 160. The rotary plate 131 will be described in detail below with reference to FIG. 6.

The channel switch motor 132 rotates the rotary plate 131 in stages by generating torque. It is preferable that the channel switch motor 132 is a step motor which progresses at a predetermined angle with every change in excitation state responding to an input pulse signal and stops and keeps a predetermined position without the excitation state changed.

Figure 6:
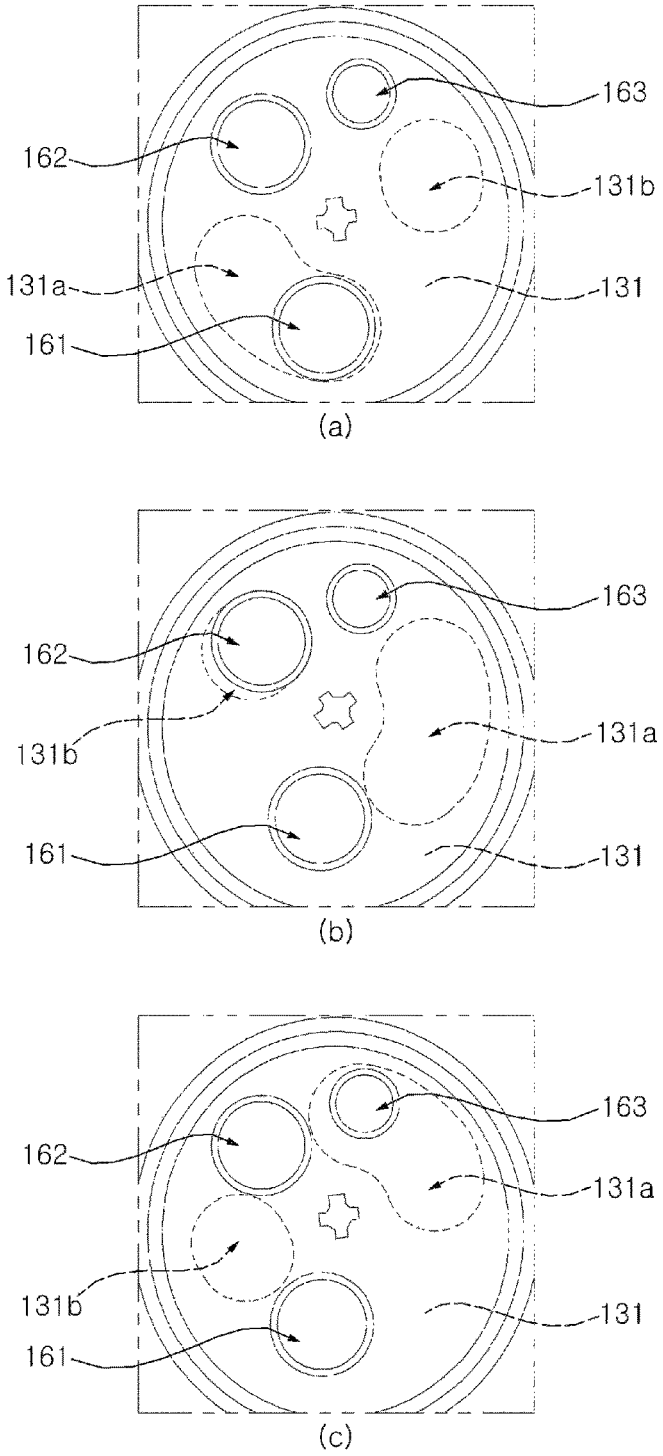
FIGS. 6 (*a*), (*b*) and (*c*) are exemplary views illustrating the operation of a channel switch unit of a dishwasher according to an exemplary embodiment of the present invention.

FIG. 6 is an exemplary view illustrating the operation of the channel switch unit of the dishwasher according to an exemplary embodiment of the present invention.

As the channel switch motor 132 rotates the rotary plate 131 to the position shown in (a) of FIG. 6 by generating torque, the first switch hole 131*a* of the rotary plate 131 opens the first connection tap 161 of the sump cover 160 and the second connection tap 162 and third connection tap 163 are closed by the rotary plate 131.

In this case, the wash water pumped to the switch water-collecting part 134 by the wash pump 150 is guided to the first wash arm connection channel 18 through the first connection tap 161 and sprayed from the first wash arm 13. That is, when the rotary plate 131 is positioned, as shown in (a) of FIG. 6, wash water is sprayed only from the first wash arm 13 and is not sprayed from the second wash arm 14 and the third wash arm 15.

When the rotary plate 131 is positioned, as shown in (b) of FIG. 6, the second switch hole 131*b* of the rotary plate 131 opens the second connection tap 162 of the sump cover 160 and the first connection tap 161 and third connection tap 163 are closed by the rotary plate 131.

In this case, the wash water pumped to the switch water-collecting part 134 by the wash pump 150 is guided to the second wash arm connection channel 19 through the second connection tap 162 and sprayed from the second wash arm 14. That is, when the rotary plate 131 is positioned, as shown in (b) of FIG. 6, wash water is sprayed only from the second wash arm 14 and is not sprayed from the first wash arm 13 and the third wash arm 15.

When the rotary plate 131 is positioned, as shown in (c) of FIG. 6, the first switch hole 131*a* of the rotary plate 131 opens the third connection tap 163 of the sump cover 160 and the first connection tap 161 and second connection tap 162 are closed by the rotary plate 131.

In this case, the wash water pumped to the switch water-collecting part 134 by the wash pump 150 is guided to the third wash arm connection channel 21 through the third connection tap 163 and sprayed from the third wash arm 15. That is, when the rotary plate 131 is positioned, as shown in (c) of FIG. 6, wash water is sprayed only from the third wash arm 15 and is not sprayed from the first wash arm 13 and the second wash arm 14.

Alternatively, the rotary plate 131 may be positioned, with the first connection tap 161 of the sump cover 160 opened by the first switch hole 131*a* of the rotary plate 131, the third connection tap 163 of the sump cover 160 opened by the second switch hole 131*b* of the rotary plate 131, and the second tap 162 closed by the rotary plate 131. In this case, wash water is sprayed from the first wash arm 13 and the third wash arm 15 and is not sprayed from the second wash arm 14.

Alternatively, the rotary plate 131 may be positioned, with the second connection tap 162 and third connection tap 163 of the sump cover 160 opened by the first switch hole 131*a* of the rotary plate 131, and the first connection tap 161 of the sump cover 160 opened by the second switch hole 131*b* of the rotary plate 131. In this case, wash water is sprayed from the first wash arm 13, second wash arm 14, and third wash arm 15.

Figure 7:
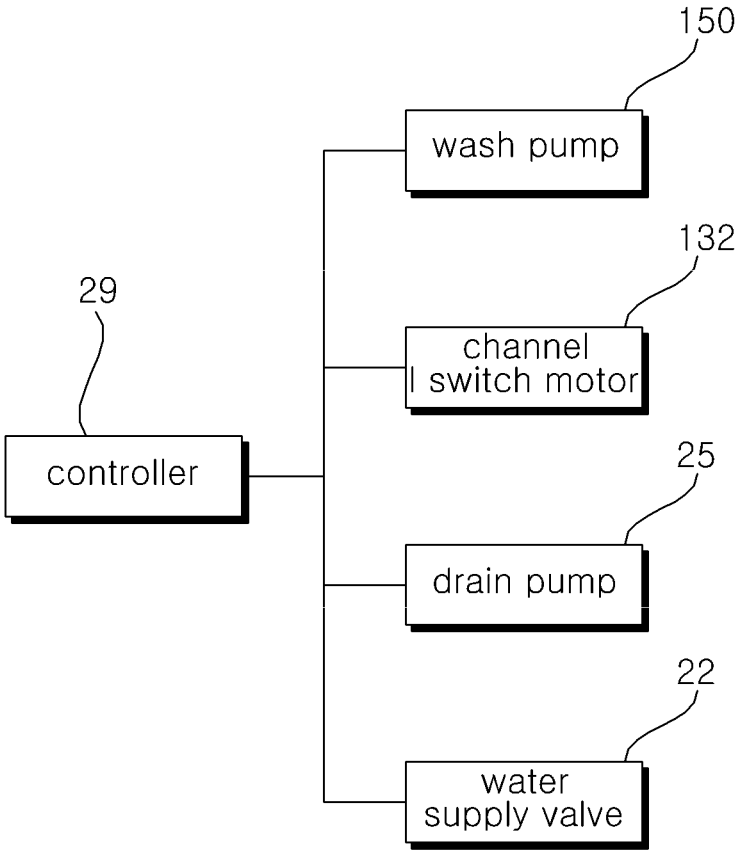
FIG. 7 is a block diagram illustrating a dishwasher according to an exemplary embodiment of the present invention.
Figure 8:
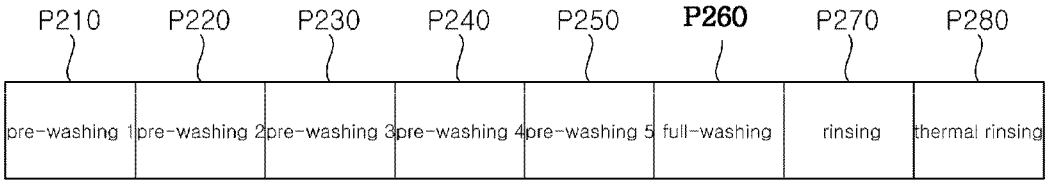
FIG. 8 is a diagram illustrating the process of cycles in a standard course of a dishwasher according to an exemplary embodiment of the present invention.

FIG. 7 is a block diagram illustrating a dishwasher according to an exemplary embodiment of the present invention and FIG. 8 is a diagram illustrating the process of cycles in a standard course of a dishwasher according to an exemplary embodiment of the present invention.

The dishwasher 1 according to an exemplary embodiment of the present invention includes a controller 29 which performs washing by controlling the wash pump 150, the channel switch motor 132, the drain pump 25, and the water supply valve 22. The controller 29 controls the wash pump 150 to circulate wash water, controls the channel switch motor 132 to spray wash water selectively from the plurality of wash arms 13, 14, and 15, controls the drain pump 25 to drain wash water out of the dishwasher 1, and controls the water supply valve 22 to supply wash water to the dishwasher 1 from an external water supplier. Further, the controller 29 may control a heater (not shown) to heat wash water or may control a steam generator (not shown) to supply steam into the tub 11.

The controller performs the cycles in a selected wash course by controlling the wash pump 150, the channel switch motor 132, the drain pump 25, and the water supply valve 22 in accordance with the selected wash course.

Referring to FIG. 8, a standard course according to an exemplary embodiment of the present invention is composed of cycles of pre-washing 1 P210, pre-washing 2 P220, pre-washing 3 P230, pre-washing 4 P240, pre-washing 5 P250, full-washing P260, rinsing P270, and thermal rinsing P280.

Each cycle of the pre-washing P210~P250 is composed of water-supplying, washing, and draining. In water-supplying, the controller 29 controls the water supply valve 22 to supply wash water into the tub 11 and/or the sump 100 from an external water supplier. The controller 29 is configured to supply a predetermined amount of wash water for washing in accordance with the selected amount of dishes or the selected course. However, as described below, some of the wash water used for the previous cycle is recycled in pre-washing P210~P250, such that wash water except the amount of recycling wash water is supplied in the water-supplying of the following pre-washing P220~P250 except the pre-washing 1 P210.

In the washing of the pre-washing P210~P250, the controller 29 operates the wash pump 150 to circulate wash water and controls the channel switch motor 132 to spray wash water from the first wash arm 13, second wash arm 14, and third wash arm 15 sequentially. That is, wash water is sprayed only from the first wash arm 13 for a predetermined time, wash water is sprayed only from the second wash arm 14 for a predetermined time, wash water is sprayed only from the third wash arm 15 for a predetermined time, and then wash water is sprayed again only from the first wash arm 13 for a predetermined time, which is repeated. The controller 29 operates the wash pump 150 for a predetermined time and controls the channel switch motor 132 such that the plurality of wash arms 13, 14, and 15 sequentially spray wash water.

In the draining of the pre-washing P210~P250, the controller 29 controls the drain pump 25 to drain the wash water in the tub 12 and the sump 100. However, as described below, some of the wash water is not drained in the pre-washing P210~P250 to be used in the following cycles, and in the draining of the previous pre-washing P210~P240 except the pre-washing P250, the controller 29 saves recycling wash water by operating both of the wash pump 150 and the drain pump 25, and then stops both of the wash pump 150 and the drain pump 25 when there is no load sensed in the drain pump 25. In the draining of the pre-washing P250, the controller 29 stops the wash pump 150 and operates only the drain pump 25 to drain wash water completely.

The full-washing P260, the rinsing P270, and the thermal rinsing P280 each are also composed of water-supplying, washing, and draining. Wash water is not recycled in the full-washing P260, rinsing P270, and thermal rinsing P280, such that the controller 29 controls the water supply valve 22 to supply a predetermined amount of wash water from an external water supplier in the water-supplying. A wash detergent is mixed into wash water in the water-supplying of the full-washing P260 and a rinse detergent is mixed into wash water in the water-supplying of the rinsing P270. In the water-supplying of the thermal rinsing P280, wash water is heated by a heater (not shown) or steam is supplied into the tub 12.

In the washing of the full-washing P260, rinsing P270, and thermal rinsing P280, the controller 29, as in the washing of the pre-washing P210~P250, operates the wash pump 150 for a predetermined time and controls the channel switch motor 132 such that the plurality of wash arms 13, 14, and 15 sequentially spray wash water.

In the draining of the full-washing P260, rinsing P270, and thermal rinsing P280, the controller 29 stops the wash pump 150 and operates the drain pump 25 to drain the wash water in the tub 12 and the sump 100 to the outside of the case 11.

Figure 9:
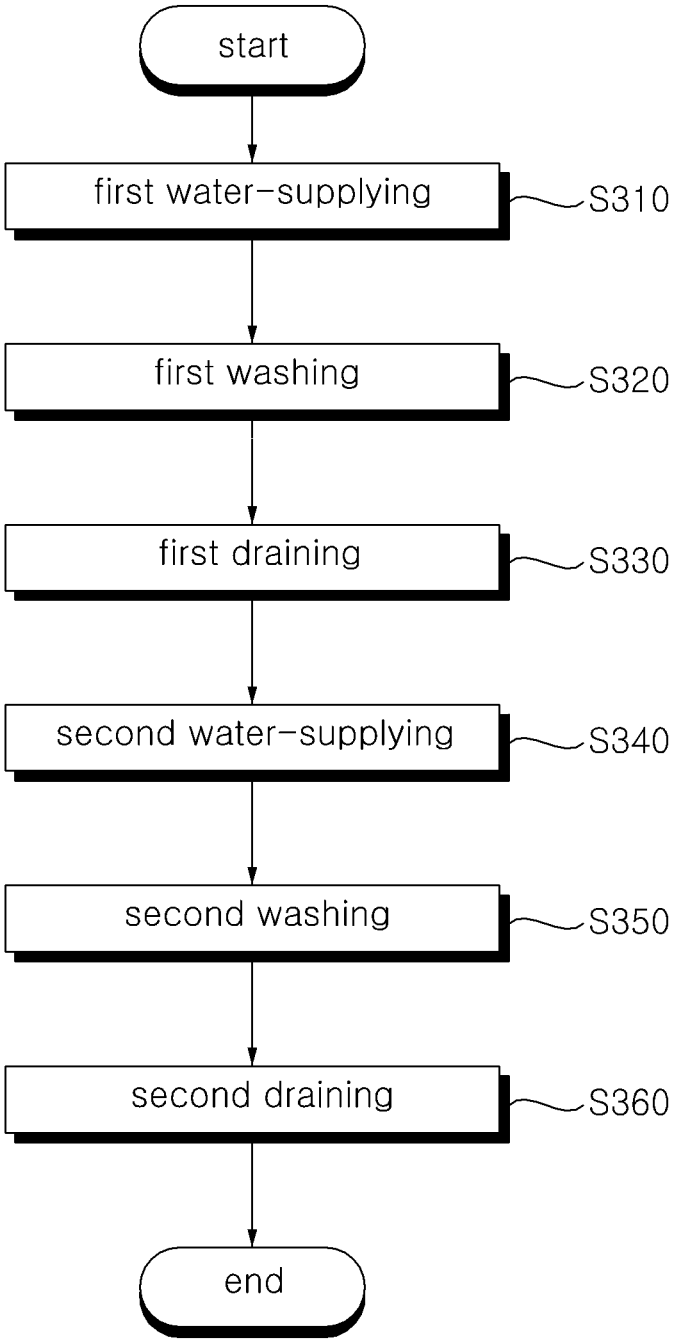
FIG. 9 is a flowchart illustrating a method of controlling a dishwasher according to an exemplary embodiment of the present invention.
Figure 10:
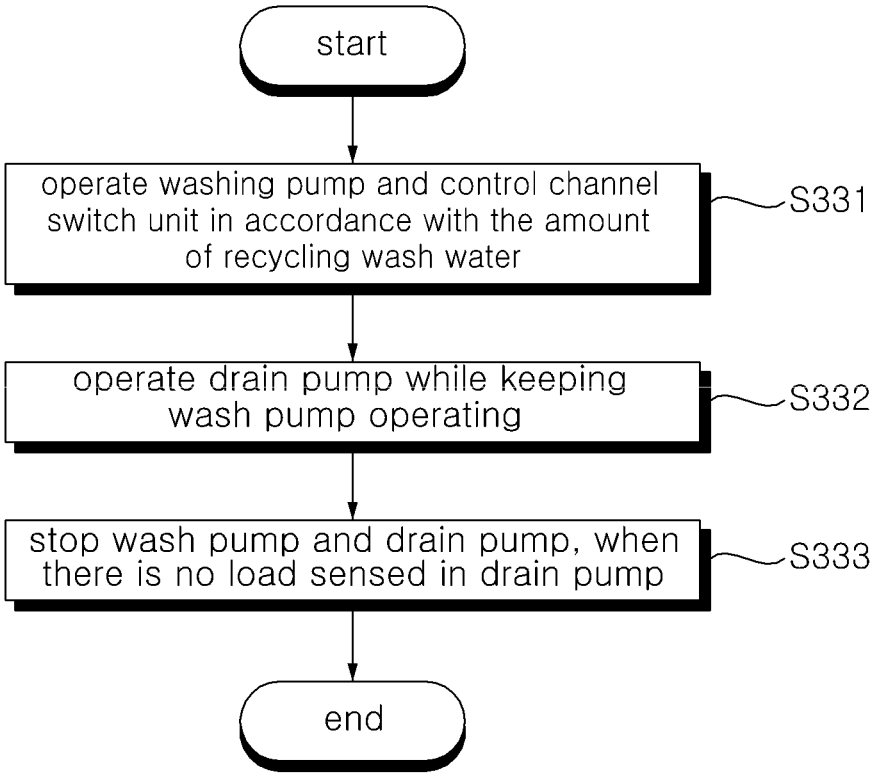
FIG. 10 is a flowchart illustrating in detail the first draining in the method of controlling a dishwasher illustrated in FIG. 9.

FIG. 9 is a flowchart illustrating a method of controlling a dishwasher according to an exemplary embodiment of the present invention and FIG. 10 is a flowchart illustrating in detail the first draining in the method of controlling a dishwasher illustrated in FIG. 9.

The control method of FIG. 9 illustrates the pre-washing 1 P210 and the pre-washing 2 P220. That is, first water-supplying S310, first washing S320, first draining S330 are the cycles of the pre-washing 1 P210, and second water-supplying S340, second washing S350, and second draining S360 are the cycles of the pre-washing 2 P220.

The controller 29 performs the first water-supplying S310 to supply a predetermined amount of wash water into the tub 11 and/or the sump 100 from an external water supplier by controlling the water supply valve 22. The controller 29 controls the water supply valve 22 to supply a predetermined amount of wash water in accordance with the selected amount of dishes or the selected course.

The controller 29 performs the first washing S320 to circulates wash water by operating the wash pump 150 and to spray wash water from the plurality of wash arms 13, 14, and 15 sequentially by controlling the channel switch motor 132. The controller 29 controls the channel switch motor 132 such that the rotary plate 131 is positioned, as shown in (a) of FIG. 6, and only the first wash arm 13 sprays wash water for A minutes, and then the rotary plate 131 is positioned, as shown in (b) of FIG. 6, and only the second wash arm 14 sprays wash water for B minutes, and then the rotary plate 131 is positioned, as shown in (c) of FIG. 6, and only the third wash arm 15 sprays wash water for C minutes, and then the rotary plate 131 is positioned again, as shown in (a) of FIG. 6, and only the first wash arm 13 sprays wash water for A minutes. The controller 29 controls the channel switch motor 132 to repeat this process.

The controller 29 performs the first draining S330 to save recycling wash water and to drain wash water by operating both of the wash pump 150 and the drain pump 25. The first draining is described hereafter with reference to FIG. 10.

The controller 29 operates the wash pump 150 operates the wash pump 150 and controls the channel switch motor 132 of the channel switch unit 130 in accordance with the amount of recycling wash water (S331). The controller 29 keeps the wash pump 150, which has been operated in the first washing, operating.

The controller 29 controls the channel switch motor 132 in accordance with the amount of recycling wash water. In the step to be described below, when the drain pump 25 is operated, wash water is left as much as the volume of the circulation channel and the rest of the wash water is drained.

The circulation channel means a portion of the filter seat 123 of the sump 100, the water-collecting channel 170 and the water-collecting part 110, the flow guide 116 of the wash pump 150, the wash water supply channel 180, the switch water-collecting part 134 of the channel switch unit 130, at least one of the wash arm connection channels 18, 19, and 20, at least one of the plurality of wash arms 13, 14, and 15, and a portion of the tub 12. Wash water selectively flows through the wash arm connection channels 18, 19, and 20 and the plurality of wash arms 13, 14, and 15 by the channel switch motor 132 of the channel switch unit 140. Since the volume of the circulation channel is changed by the control of the channel switch motor 132, the controller 29 adjusts the amount of recycling wash water by controlling the channel switch motor 132.

In the exemplary embodiment, the third wash arm 15 is smaller in volume than the first wash arm 13 and the second wash arm 14, such that, in order to minimize the amount of recycling wash water, the controller 29 positions the rotary plate 131, as in (c) of FIG. 6, by controlling the channel switch motor 132.

Further, in order to maximize the amount of recycling wash water, the controller 29 positions the rotary plate 131, with the second connection tap 162 and third connection tap 163 of the sump cover 160 opened by the first switch hole 131*a* of the rotary plate 131, and the first connection tap 161 of the sump cover 160 opened by the second switch hole 131*b* of the rotary plate 131, by controlling the channel switch motor 132. In this case, all of the volumes of the first wash arm 13, second wash arm 14, and third wash arm 15 and the volumes of the first wash arm connection channel 18, second wash arm connection channel 19, and third wash arm connection channel 21 are available, such that the amount of recycling wash water is the largest.

The volume of the circulation channel depends on the volume of at least one of the plurality of wash arms 13, 14, and 15 selected by the channel switch motor 132 and the volume of at least one of the connection taps 161, 162, and 163 connected with the wash arm, so the amount of recycling wash water is determined. It is preferable that the controller 29 increases the amount of recycling wash water, as the predetermined amount of wash water for cleaning increases.

The controller 29 adjusts the amount of recycling wash water by controlling the channel switch motor 132 and then operates the drain pump 25, keeping the wash water 150 operating (S332). As both of the wash pump 150 and the drain pump 25 are operated, wash water circulates along the circulation channel and the wash water in the tub 12 is drained through the filter seat 123 and the drain channel 24.

The controller 29 stops both of the wash pump 150 and the drain pump 25, when there is no load sensed in the drain pump 25 (S333). The reason that there is no load sensed in the drain pump 25 is because wash water remains only in the circulation channel and all of the wash water collecting on the bottom of the tub 12 and the wash water over the portion where the drain channel 24 is connected in the filter seat 123 is drained, such that the controller 29 ends the first draining by stopping both of the wash pump 150 and the drain pump 25 as soon as no load is sensed in the drain pump 25. When both of the wash pump 150 and the drain pump 25 are stopped, wash water is left as much as the volume of the circulation channel and the rest of the wash water is drained to the outside of the case 11.

However, the drain pump 25 may be stopped first and then the wash pump 150 may be stopped, depending on exemplary embodiments.

The controller 29 performs the second water-supplying S340 to supply predetermined amount of wash water, except the amount of recycling wash water, into the tub 11 and/or the sump 100 from an external water supplier by controlling the water supply valve 22. The controller 29 controls the water supply valve 22 to supply wash water, except the amount of wash water controlled by the channel switch motor 132 to be recycled from the amount of wash water determined in accordance with the selected amount of dishes or the selected course.

The controller 29 performs the second washing S330 to circulate wash water by operating the wash pump 150 and to spray wash water from the plurality of wash arms 13, 14, and 15 sequentially by controlling the channel switch motor 132. The second washing is the same as the first washing and not described.

The controller 29 performs the second draining S360 to save recycling wash water and to drain wash water by operating both of the wash pump 150 and the drain pump 25. The second draining is the same as the first draining and not described.

When the second draining is that in the pre-washing 5 P250, the controller 29 stops the wash pump 150 and operates the drain pump 25 to drain completely. Since wash water is not recycled in the full-washing P260, the wash water in the tub 12 and the sump 100 is completely drained outside by stopping the wash pump 150 and operating the drain pump 25.

According to a dishwasher and a method of controlling the dishwasher of the present invention, one or more effects can be achieved as follows.

First, it is possible to save water by recycling some of the wash water used in the previous rinsing.

Second, it is possible to recycle wash water without a specific device by using the volume of the circulation channel.

Third, it is possible to adjust the amount of recycling wash water in accordance with the selected amount of dishes or the selected course, and the cycle in process.

The effects of the present invention are not limited to those described above and other effects not stated herein may be made apparent to those skilled in the art from claims.

What is claimed is:

1. A method of controlling a dishwasher having a circulation channel through which wash water is supplied directly from a sump to a plurality of wash arms using a wash pump, the method comprising:

performing a first water-supplying for supplying a first predetermined amount of wash water into the dishwasher by opening a water supply valve;

performing a first washing wherein the plurality of wash arms spray the wash water into a tub of the dishwasher, said water collecting in the sump;

performing a first draining including:

operating the wash pump and a drain pump, wherein a portion of the collected wash water flows directly from the sump to the circulation channel by the wash pump, and wherein a remaining portion of the collected wash water outside the circulation channel is drained outside of the dishwasher by the drain pump, and stopping the wash pump and the drain pump when the collected wash water is present only in the circulation channel and no load is sensed in the drain pump, wherein the portion of wash water in the circulation channel after the wash pump and the drain pump are stopped is saved wash water, and wherein an amount of the saved wash water is dependent on a volume of the circulation channel; and performing a second water-supplying for supplying a second predetermined amount of wash water into the dishwasher, the second predetermined amount of wash water, less the amount of the saved wash water, is supplied by opening the water supply valve, wherein the circulation channel comprises:

a part of the sump including a water collecting part, a wash water supply channel, and a water collecting channel disposed in the sump;

at least one of the plurality of wash arms; and at least one of a plurality of wash arm connection channels, wherein the plurality of wash arm connection channels connects the plurality of wash arms with the sump, respectively, wherein the circulation channel further comprises a rotary plate which controls the flow of wash water from the wash water supply channel, wherein the rotary plate includes switch holes which directs the water to one of the plurality of wash arms, wherein according to the rotation of the rotary plate, the switch holes communicate with at least one of the connection channels so that a volume of the circulation channel that can save the wash water changes depending on which switch hole is communicated with, and wherein the second predetermined amount of wash water is guided to the water collecting part through the water collecting channel and the saved wash water and the second predetermined amount of wash water are pumped directly from the sump to the plurality of wash arms by the wash pump.

2. The method of claim 1, further comprising:

performing a second washing where the plurality of wash arms spray the wash water into the tub by operating the wash pump after the second water-supplying; and performing a second draining for draining completely the wash water to the outside of the dishwasher by stopping the wash pump and operating the drain pump.

3. The method of claim 1, further comprising:

performing a second washing where the plurality of wash arms spray wash water into the tub by operating the wash pump after the second water-supplying; and performing a second draining for saving a portion of wash water in the circulation channel, wherein an amount of the saved wash water is dependent on the volume of the circulation channel and draining the rest of the wash water to the outside of the dishwasher by operating the wash pump and the drain pump, wherein the second draining comprises:

operating the wash pump;

operating the drain pump while keeping the wash pump operating; and stopping the wash pump and the drain pump when water is present only in the circulation channel.

4. The method of claim 1, wherein a channel switch unit for selectively supplying wash water to at least one of the plurality of wash arms is disposed in the circulation channel, and the channel switch unit is arranged to adjust the amount of saved wash water in the circulation channel in the first draining.

5. The method of claim 1, wherein the wash pump and the drain pump are stopped at the same time in the first draining.

6. The method of claim 1, wherein the wash pump is stopped and then the drain pump is stopped in the first draining.

7. The method of claim 2, further comprising:

performing a third water-supplying for supplying a third predetermined amount of wash water into the dishwasher by opening the water supply valve.

* * * * *